US010240511B2

(12) United States Patent
Clark et al.

(10) Patent No.: US 10,240,511 B2
(45) Date of Patent: Mar. 26, 2019

(54) ENGINE WITH COOLING SYSTEM

(71) Applicant: Cummins, Inc., Columbus, IN (US)

(72) Inventors: Mathew Clark, Darlington (GB); Nathaniel P. Hassall, Thirsk (GB); John Jerl Purcell, III, Louisa, VA (US)

(73) Assignee: Cummins Inc., Columbus, IN (US)

( * ) Notice: Subject to any disclaimer, the term of this patent is extended or adjusted under 35 U.S.C. 154(b) by 28 days.

(21) Appl. No.: 14/441,731

(22) PCT Filed: Nov. 26, 2013

(86) PCT No.: PCT/US2013/071835
§ 371 (c)(1),
(2) Date: May 8, 2015

(87) PCT Pub. No.: WO2014/085377
PCT Pub. Date: Jun. 5, 2014

(65) Prior Publication Data

US 2015/0292389 A1 Oct. 15, 2015

Related U.S. Application Data

(60) Provisional application No. 61/730,789, filed on Nov. 28, 2012.

(51) Int. Cl.
*F02F 1/42* (2006.01)
*F01P 3/02* (2006.01)
(Continued)

(52) U.S. Cl.
CPC ..... *F01P 3/02* (2013.01); *F02F 1/10* (2013.01); *F02F 1/36* (2013.01); *F01P 2003/024* (2013.01); *F01P 2003/028* (2013.01)

(58) Field of Classification Search
CPC ..... F02F 1/40; F02F 1/243; F01P 3/02; F01P 2003/024; F01P 2003/028; F01P 3/14
(Continued)

(56) References Cited

U.S. PATENT DOCUMENTS 4,312,304 A * 1/1982 Tyner ..... F01P 3/02 123/41.31
4,700,665 A * 10/1987 Kanda ..... F02F 1/242 123/193.5

(Continued)

FOREIGN PATENT DOCUMENTS

| | | |
|---|---|---|
| CN | 1662737 | 8/2005 |
| CN | 101044304 | 9/2007 |
| JP | H 04-237692 | 8/1992 |

OTHER PUBLICATIONS

The International Search Report and Written Opinion of the International Searching Authority issued for PCT/US2013/071835, dated Apr. 18, 2014.

(Continued)

*Primary Examiner* — Marguerite McMahon
*Assistant Examiner* — James Kim
(74) *Attorney, Agent, or Firm* — Foley & Lardner LLP

(57) ABSTRACT

An engine assembly and method of distributing coolant in an engine assembly. A cylinder block includes one or more pairs of cylinder block openings disposed therein. Each pair of cylinder block openings include two cylinder block openings, each configured to house a piston. A cylinder head in fluid communication with the one or more pairs of cylinder block openings. A coolant manifold includes coolant flow passages, each in fluid communication with a coolant flow inlet disposed in the cylinder block between the two cylinder block openings in each pair of cylinder block openings. Fluid from each coolant flow inlet diverges into two coolant flow passages, each extending about a peripheral portion of a respective cylinder block opening. Each coolant flow passage extends from the peripheral portion of the respective cylinder block opening into one or more outlets from the engine block and into the cylinder head.

20 Claims, 7 Drawing Sheets

(51) Int. Cl.
*F02F 1/10* (2006.01)
*F02F 1/36* (2006.01)

(58) Field of Classification Search
USPC ..... 123/193.5, 195 R, 41.72, 41.74, 41.79
See application file for complete search history.

(56) References Cited

U.S. PATENT DOCUMENTS 4,736,716 A * 4/1988 Ohyama ..... F01P 3/02 123/41.78
4,996,952 A * 3/1991 Hall ..... F01P 5/12 123/198 C
5,080,049 A * 1/1992 Solomon ..... F01P 3/02 123/41.78
5,115,771 A * 5/1992 Ozawa ..... F01P 3/02 123/193.2
5,152,255 A 10/1992 Fukuda
5,188,071 A * 2/1993 Han ..... F02F 1/108 123/195 R
5,386,805 A * 2/1995 Abe ..... F01P 3/02 123/41.28
5,596,954 A * 1/1997 Kennedy ..... F02F 1/16 123/41.79
5,765,282 A 6/1998 Sweetland et al.
6,223,702 B1 * 5/2001 Achenbach ..... F02F 1/10 123/41.71
6,289,855 B1 * 9/2001 Romblom ..... F02F 1/108 123/41.72
6,776,127 B2 * 8/2004 Osman ..... F02F 1/14 123/41.72
7,051,685 B2 5/2006 Hayman et al.
7,225,766 B2 * 6/2007 Zahdeh ..... F02F 1/108 123/41.79
7,234,422 B2 * 6/2007 Schlautman ..... F02F 7/007 123/41.74
2005/0061286 A1 * 3/2005 Molina ..... F02F 1/24 123/193.3
2005/0087154 A1 4/2005 Haymen
2011/0308237 A1 * 12/2011 Nagayama ..... F01N 13/102 60/321
2011/0315098 A1 * 12/2011 Kosugi ..... B22C 9/103 123/41.74
2012/0006287 A1 * 1/2012 Hayman ..... F01L 1/053 123/41.79
2012/0138007 A1 * 6/2012 Smith ..... B22C 9/103 123/193.5
2013/0247847 A1 * 9/2013 Nogawa ..... F01P 3/02 123/41.34

OTHER PUBLICATIONS

First Office Action cited in Chinese Patent Application No. 201380060776.6, dated Jan. 5, 2017, 9 pages.

* cited by examiner

Coolant manifold
CYLINDERS 1-6
101
201
224
226
228
230
232
234
236
238
301
340
342
344
346
350
352
354
401
456
458
460

Block Water Jacket

ENGINE WITH COOLING SYSTEM

CROSS REFERENCE TO RELATED APPLICATIONS

The present application is a National Stage of PCT Application No. PCT/US2013/071835, filed Nov. 26, 2013, which claims priority to U.S. Provisional Application No. 61/730,789, filed Nov. 28, 2012 and entitled "ENGINE WITH COOLING SYSTEM," the contents of which are incorporated herein by reference in their entirety.

TECHNICAL FIELD

This disclosure relates to an internal combustion engine having an engine cooling system to cool an engine block and cylinder head.

BACKGROUND

Engine components such as the engine block and cylinder head require cooling systems to maintain efficient and effective operation of the engine. Cooling the engine in a substantially uniform manner presents various challenges associated with coolant distribution, heat transfer, pressure variations, and other dynamics of an engine and the process of manufacturing related components.

SUMMARY

Various embodiments provide an engine assembly and method of distributing coolant in an engine assembly and related components.

In particular embodiments, an engine assembly is provided. The engine assembly includes a cylinder block including one or more pairs of cylinder block openings disposed therein. The one or more pairs of cylinder block openings each include two cylinder block openings each configured to house a piston. The engine assembly also includes a cylinder head coupled to the cylinder block such that the cylinder head is in fluid communication with the one or more pairs of cylinder block openings. The engine assembly further includes a coolant manifold coupled to the cylinder block. The coolant manifold includes a plurality of coolant flow passages. Each coolant flow passage is in fluid communication with a coolant flow inlet disposed in the cylinder block between the two cylinder block openings in the one or more pairs of cylinder block openings. Fluid from each coolant flow inlet diverges into two coolant flow passages, each coolant flow passage extends about a peripheral portion of a respective cylinder block opening in the one or more pairs of cylinder block openings. Each coolant flow passage extends from the peripheral portion of the respective cylinder block opening in the one or more pairs of cylinder block openings into one or more outlets from the engine block and into the cylinder head.

In particular embodiments, the cylinder head includes a cylinder head coolant manifold having a coolant flow path extending from the one or more outlets from the engine block to the cylinder head coolant manifold including a water jacket adjacent to a valve seat of an air intake port. The water jacket is in fluid communication with an area adjacent to a valve seat of a combustion gas exhaust port. In particular embodiments, the cylinder head coolant manifold is configured to transfer coolant flow in the water jacket from an area adjacent to the valve seat of the combustion gas exhaust port of one cylinder to an area adjacent to the valve seat of the combustion gas exhaust port of an adjacent cylinder. In particular embodiments, the coolant flow passages include a cross channel between each pair of cylinder block openings. The cross channel provides fluid communication between at least one coolant flow passage of each pair of cylinder block openings. Each coolant flow passage may extend bi-directionally about the peripheral portion of the respective cylinder block opening in the one or more pairs of cylinder block openings. In particular embodiments, the one or more pairs of cylinder block openings includes a plurality of pairs of cylinder block openings. Each coolant flow passage extends into two outlets from the engine block and into the cylinder head. Each coolant flow inlet may be spaced substantially equidistant from each of a pair of cylinder block openings in the engine block. The coolant flow passages extend about a peripheral portion of a respective cylinder block opening in the one or more pairs of cylinder block openings are casted passages.

Other various embodiments provide a method of distributing coolant in an engine assembly. The method includes causing coolant to flow from a coolant manifold to a cylinder block coupled to the coolant manifold. The cylinder block includes one or more pairs of cylinder block openings disposed therein. The one or more pairs of cylinder block openings each includes two cylinder block openings each configured to house a piston. The coolant manifold includes a plurality of coolant flow passages. Each coolant flow passage is in fluid communication with a coolant flow inlet disposed in the cylinder block between the two cylinder block openings in the one or more pairs of cylinder block openings. The method further includes causing coolant to flow from the cylinder block to a cylinder head coupled to the cylinder block. The cylinder head is coupled to the cylinder block such that the cylinder head is in fluid communication with the one or more pairs of cylinder block openings. In the method causing the coolant to flow to the cylinder block includes causing the coolant from each coolant flow inlet to diverge into two coolant flow passages, each coolant flow passage extending about a peripheral portion of a respective cylinder block opening in the one or more pairs of cylinder block openings. Each coolant flow passage extends from the peripheral portion of the respective cylinder block opening in the one or more pairs of cylinder block openings into one or more outlets from the engine block and into the cylinder head.

In particular embodiments, the method also includes causing coolant to flow into a cylinder head coolant manifold of the cylinder head from the one or more outlets from the engine block to an intake port and from the intake port to an exhaust port. The method also includes causing coolant to flow from the exhaust port of one cylinder to an exhaust port of an adjacent cylinder. Fluid is also caused to flow between each pair of cylinder block openings via a cross channel between the cross channel providing fluid communication between at least one coolant flow passage of each pair of cylinder block openings.

The inventors have appreciated that the implementation and use of various embodiments may result in beneficial engine cooling. It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the subject matter described herein. The drawings are not necessarily to scale; in some instances, various aspects of the subject matter disclosed herein may be shown exaggerated or enlarged in the drawings to facilitate an understanding of different features. In the drawings, like reference characters generally refer to like features (e.g., functionally similar and/or structurally similar elements).

The features and advantages of the inventive concepts disclosed herein will become more apparent from the detailed description set forth below when taken in conjunction with the drawings.

DETAILED DESCRIPTION

Following below are more detailed descriptions of various concepts related to, and embodiments of, inventive systems, and methods of forming an engine block. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Figure 1:
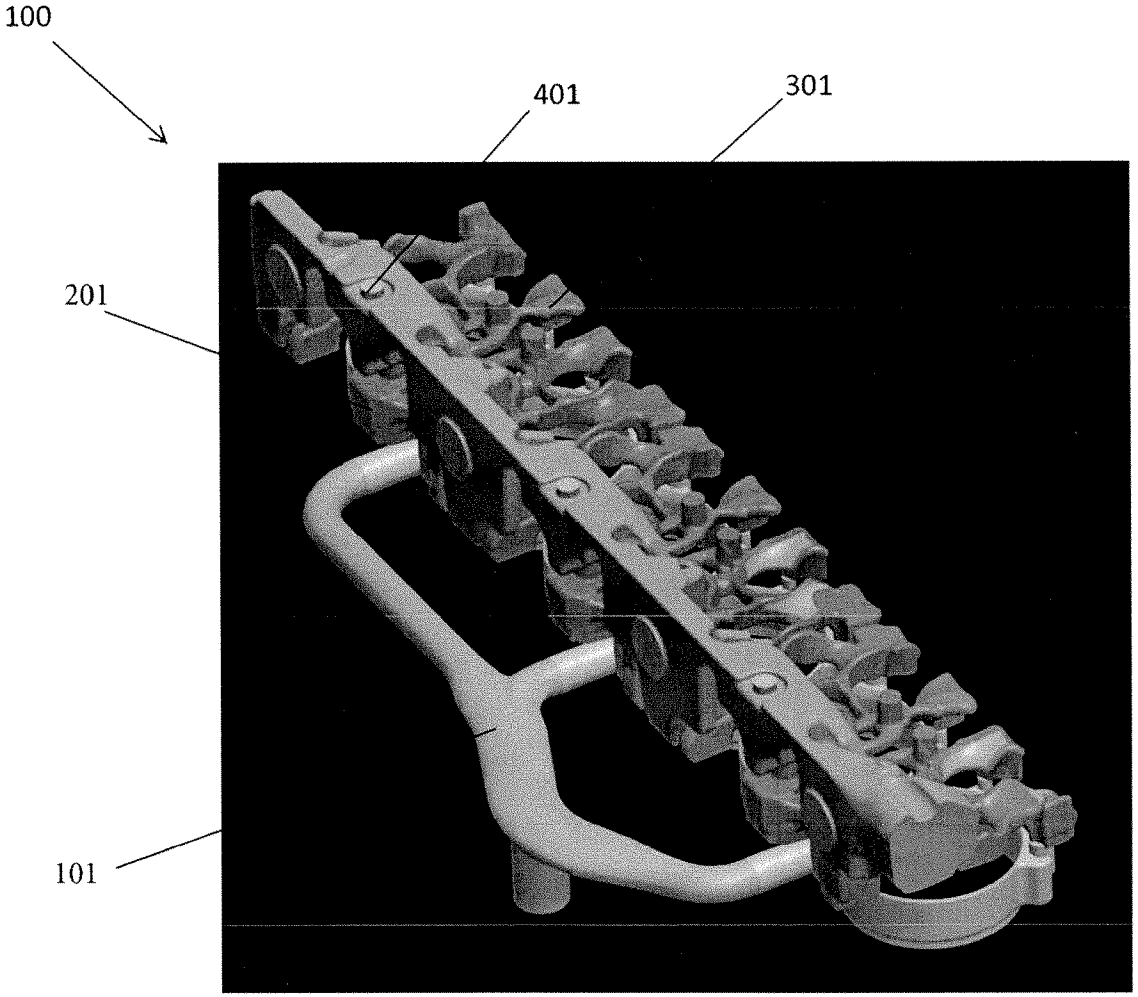
FIG. 1 shows a cooling system for an engine in accordance with exemplary embodiments.

FIG. 1 shows a cooling system for an engine in accordance with exemplary embodiments. The cooling system 100 includes a coolant manifold 101, distributing cooling fluid through three channels in the illustrated embodiment. The three channels feed cooling fluid into the cooling passages forming a cylinder block water jacket 201, which as discussed further herein provides a plurality of coolant flow passages extending about a peripheral portion of a respective cylinder block opening in an engine cylinder block. The cooling system 100 also includes coolant flow passages (not shown in FIG. 1) forming a coolant manifold in the cylinder head, which passages extend through a lower cylinder head portion 301. The cooling system 100 also includes coolant flow passages forming an additional coolant manifold (not shown in FIG. 1) in the cylinder head, which passages extend through an upper cylinder head portion 401 in accordance with exemplary embodiments.

Figure 2:
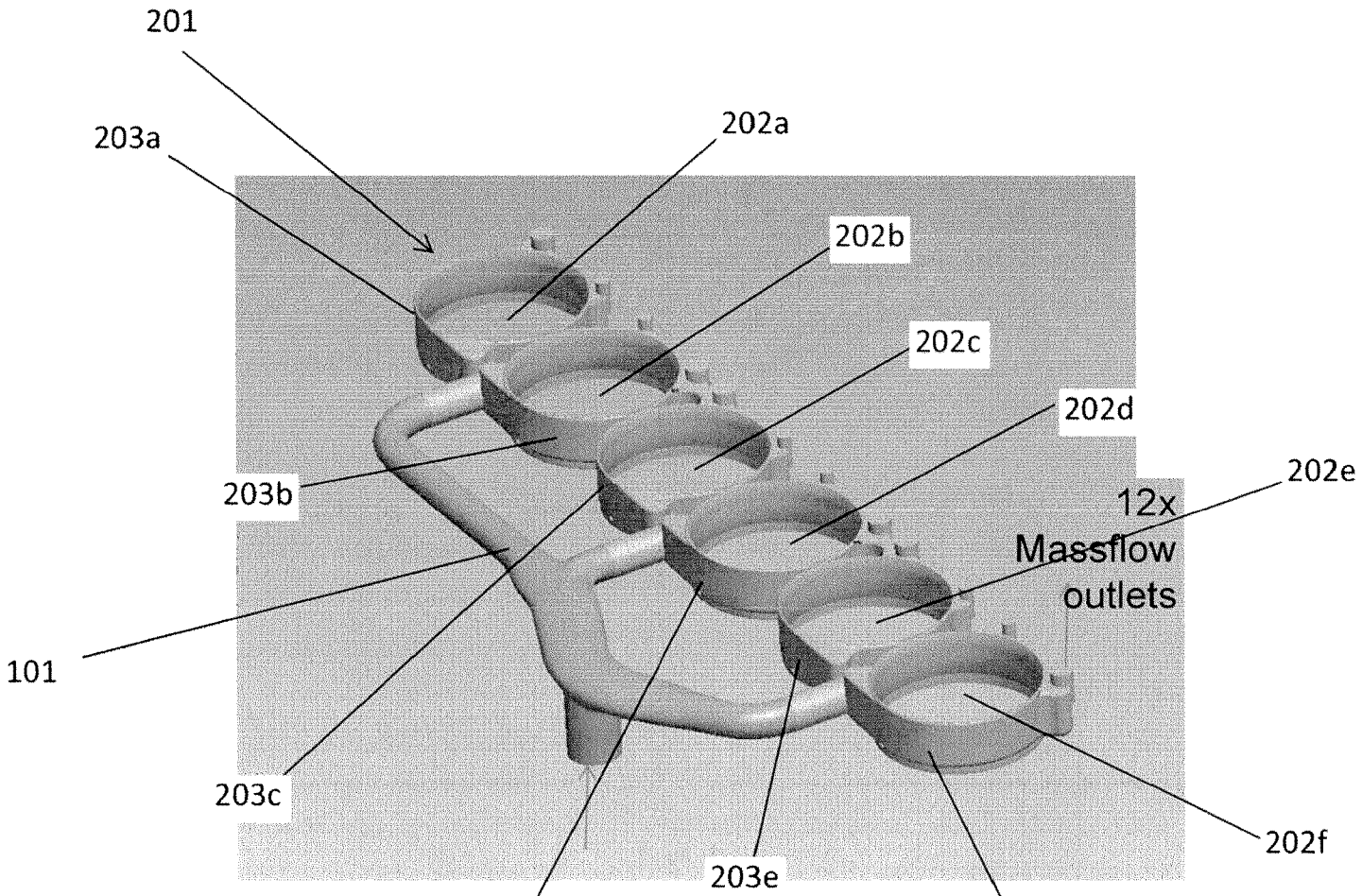
FIG. 2 illustrates the coolant manifold connected to engine block components in accordance with exemplary embodiments.

FIG. 2 illustrates the coolant manifold connected to engine block components in accordance with exemplary embodiments. More specifically, FIG. 2 shows the cylinder block water jacket 201 connected to the coolant manifold 101 for transfer of fluid from the coolant manifold 101 to the cylinder block water jacket 201. The cylinder block water jacket 201 includes a plurality of coolant flow passages 203*a*-203*f* extending about a peripheral portion of cylinder block openings 202*a*-202*f* in an engine cylinder block. The engine block openings 202*a*-202*f* are disposed in an engine block in accordance with exemplary embodiments and are configured to house engine pistons. As demonstrated further herein, the coolant flow passages 203*a*-203*f* extend to outlets that transfer cooling fluid from the cylinder block to the cylinder head in accordance with exemplary embodiments. The coolant flow passages 203*a*-203*f* may be formed in an engine block via casting, wherein the shape of the coolant flow passage is integrated into a mold core for the engine block openings 202*a*-202*f* in accordance with exemplary embodiments.

Figure 3:
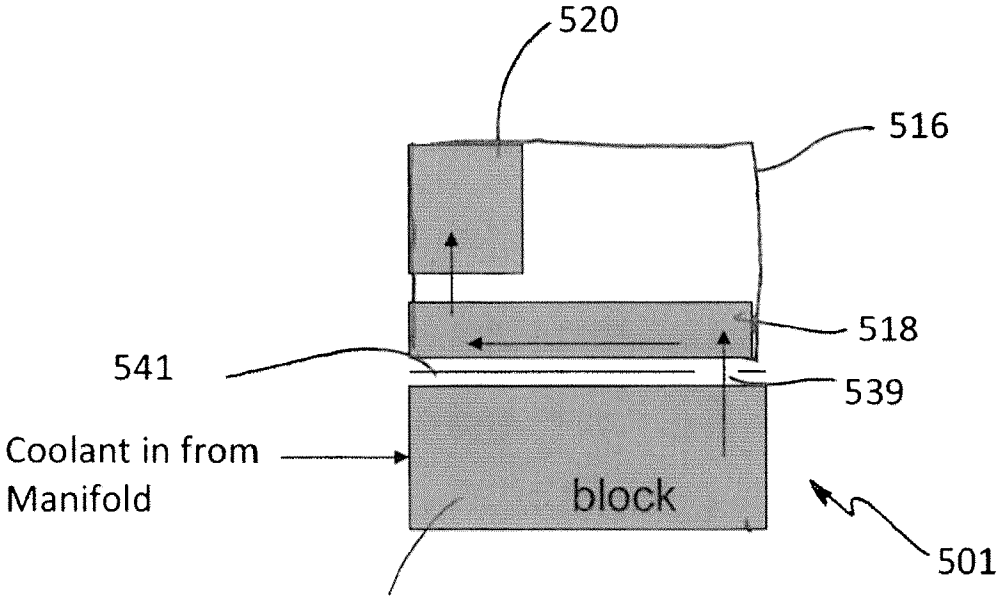
FIG. 3 shows a side view schematic of the coolant flow path through an engine in accordance with exemplary embodiments.

FIG. 3 shows a side view schematic of the coolant flow path through an engine in accordance with exemplary embodiments. Engine 501 includes an engine block 514, and a cylinder head 516 including a lower cylinder head portion 518 and an upper cylinder head portion 520 in the illustrated embodiment. The engine block 514 houses a plurality of cylinder block openings configured to house pistons. The cylinder head 516 houses intake and exhaust valves. The general flow of coolant or cooling fluid through the engine includes coolant flowing into the engine block 514 from the coolant manifold. The coolant flows around cylinder block openings for transfer laterally across the engine block 514 generally from an intake side to an exhaust side. After traversing the engine block 514 laterally, the coolant then flows upward to the cylinder head 516 via an opening in an outlet such as a flow restriction orifice 539. The coolant then moves generally laterally across the lower cylinder head portion 518 before moving upward into the upper cylinder head portion 520.

The block and head cooling system directs cooling fluid or coolant into a first side of the engine block 514 into various passages, directing the fluid transversely through the block to an opposite second side of block 514 and then upwardly toward to a top surface of block 514. Cylinder head 516 includes various passages positioned to receive the coolant from the opposite second side of block 514 and direct the coolant transversely back across head 516, and more specifically, lower cylinder head portion 518 to the first side of engine 501. As discussed further, herein the passages in the cylinder head facilitate flowing coolant about the intake port and intake valve seat as well as about the combustion gas exhaust port and exhaust valve seat. The upper cylinder head portion 520 also contains passages positioned to receive the coolant from lower cylinder head portion 518. The general cooling circuit flow pattern advantageously cools the engine. This cooling circuit is especially advantageous for a cylinder block with wet liners and a cylinder head with three valves per cylinder. This system could be applied to an inline engine of even number of cylinders, or V engine having 4, 8, 12, etc., number of cylinders.

Figure 4:
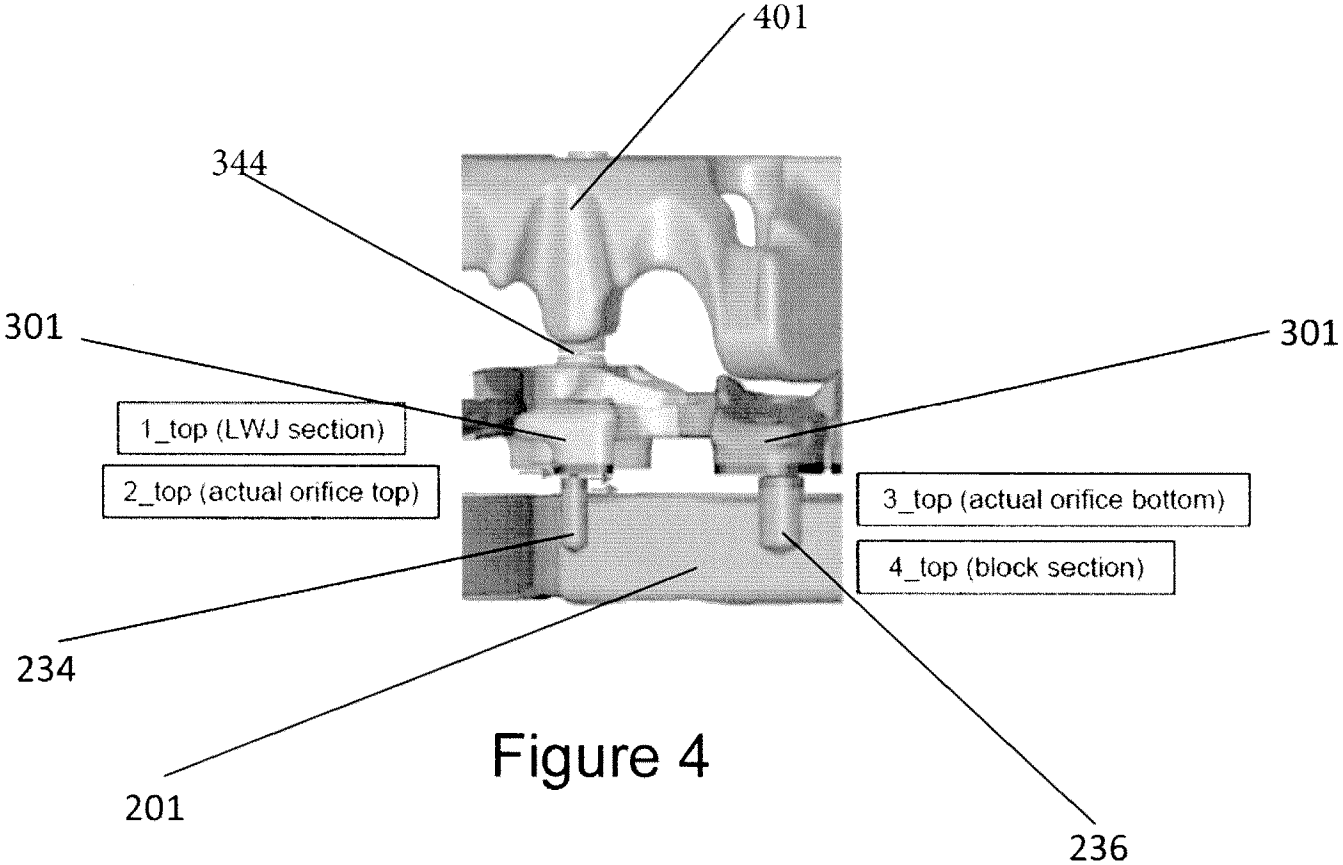
FIG. 4 shows a partial view of the transition of the coolant flow paths from the engine block section to the lower water jacket section in accordance with exemplary embodiments.

FIG. 4 shows a partial view of the transition of the coolant flow paths from the engine block section to the lower water jacket section in accordance with exemplary embodiments. FIG. 4 shows a side view of a section of the cooling system 100 illustrating outlet passages 234 and 236 extending from coolant flow passages of the cylinder block water jacket 201. The outlet passages 234 and 236, which may include a flow restriction orifice, permit coolant to move from the cylinder block water jacket 201 to the lower cylinder head portion 301. After transmitting across the lower cylinder head portion 301, the coolant then moves into the upper cylinder head portion 401 via outlet passages such as outlet passage 344.

Figures 5A, 5B, 5C:
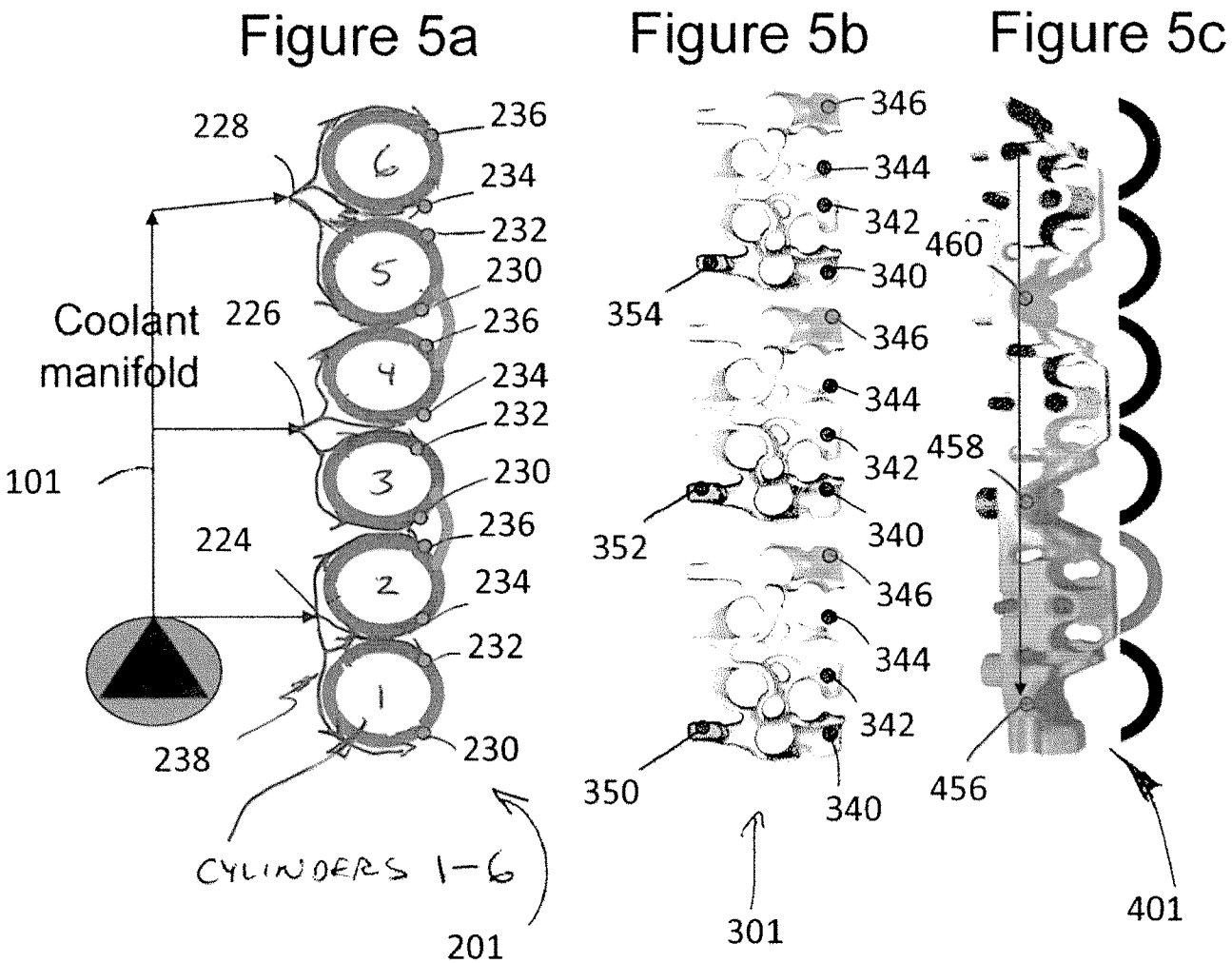
FIG. 5*a* shows a top view of a cylinder block having a coolant system in accordance with exemplary embodiments.
FIG. 5*b* shows a top view of a lower cylinder head portion having a coolant system in accordance with exemplary embodiments.
FIG. 5*c* shows a top view of an upper cylinder head portion having a coolant system in accordance with exemplary embodiments.

FIG. 5*a* shows a top view of a cylinder block having a coolant system in accordance with exemplary embodiments. FIG. 5*b* shows a top view of a lower cylinder head portion having a coolant system in accordance with exemplary embodiments. FIG. 5*c* shows a top view of an upper cylinder head portion having a coolant system in accordance with exemplary embodiments. More specifically, FIGS. 5*a*, 5*b*, and 5*c* show top views of the block flow passages, lower head portion flow passages, and upper head portion flow passages, respectively, which distribute coolant to the cylinder block and cylinder head. Coolant is first distributed from the coolant manifold 101 into block water jacket 201 at three locations or passages 224, 226, 228 in block 514, each location being in between two cylinders and preferably between distinct pairs of cylinders, e.g., pair of cylinders 1 and 2; pair of cylinders 3 and 4; pair of cylinders 5 and 6, so that each pair receives flow from manifold 101 at one location. FIG. 5*a* shows the coolant flow direction in the block around each cylinder before entering two outlet passages associated with each cylinder and thus four outlet passages 230, 232, 234, and 236 for each pair of cylinders.

The lower cylinder head portion 301 includes a plurality of inlet passages 340, 342, 344, and 346, corresponding in number to the number of outlet passages from block water jacket 201 that extend upwardly from the bottom surface of the cylinder head (such as the cylinder head 516) to connect to a coolant cavity or head water jacket formed in the cylinder head to distribute flow across the cylinder head around areas of the head containing valves, fuel injectors, etc. In the case of the cylinder head requiring an uneven distribution for cylinders A and B of the cylinder pair, cross channels, such as cross channels 237, 239 between adjacent cylinder pairs to adjacent cylinders A and B in block may exist for flow balancing (see FIG. 5*a*).

In the exemplary embodiment depicted in FIGS. 5*a*-5*c*, coolant flows through lower cylinder head portion 301, taking paths to and around the intake valves and injector while all flow is directed around the single exhaust valve seat of each cylinder. The lower cylinder head portion 301 includes a single outlet passage for each pair of cylinders, and thus three outlet passages 350, 352, 354 for the exemplary embodiment, to receive and direct coolant flow head out of the head or in the exemplary embodiment, into the upper cylinder head portion 401. The upper cylinder head portion 401 includes three outlet passages 456, 458, 460 for receiving coolant flow from passages 350, 352, 354.

Figure 6:
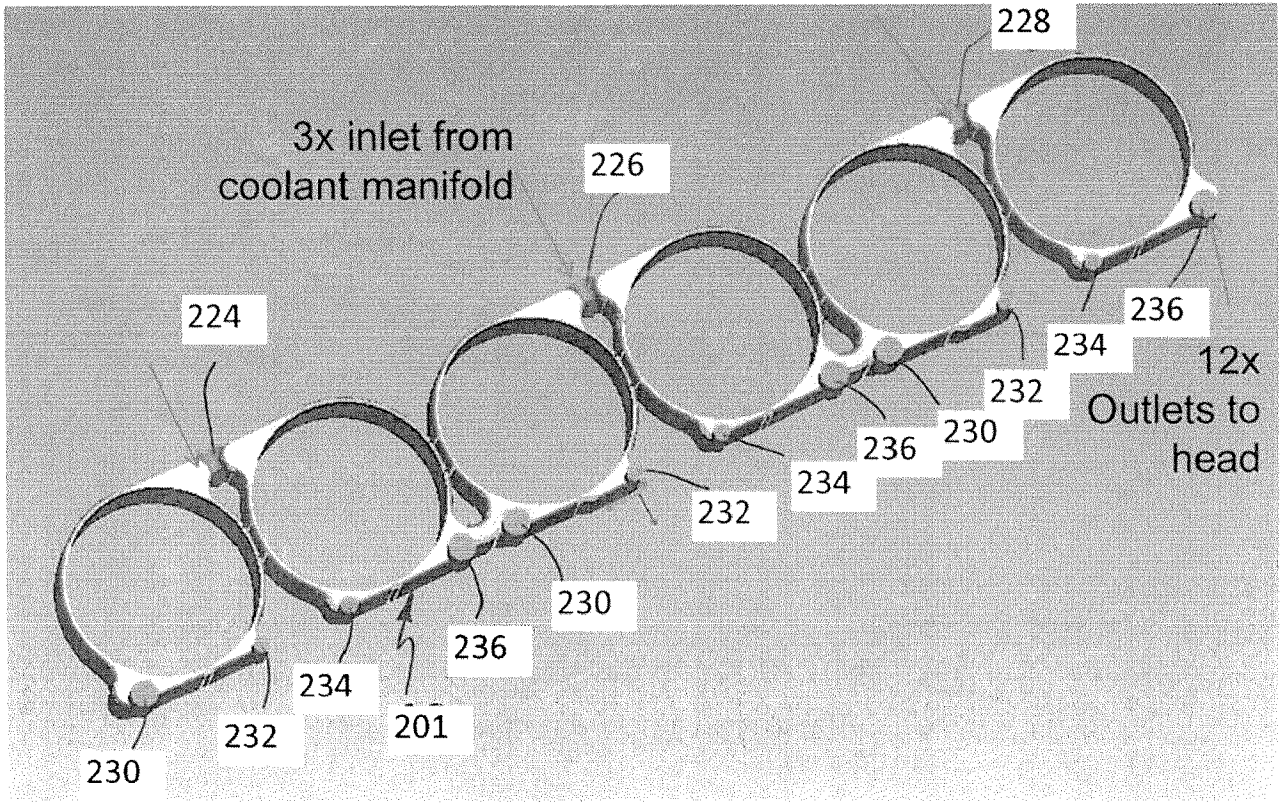
FIG. 6 shows a perspective view of a block water jacket in accordance with exemplary embodiments.

FIG. 6 shows a top perspective view of the block water jacket 201 for receiving the coolant flow and directing coolant around each cylinder to the outlets. In the exemplary engine having six cylinders, there are twelve outlets. However, other even numbers of cylinders and outlets may be used. The layout of each cylinder in the pair is a mirror image of the other. Thus, coolant flows from the center of each cylinder pair to the opposite extremes, through a water jacket around both sides of each cylinder.

Figure 7:
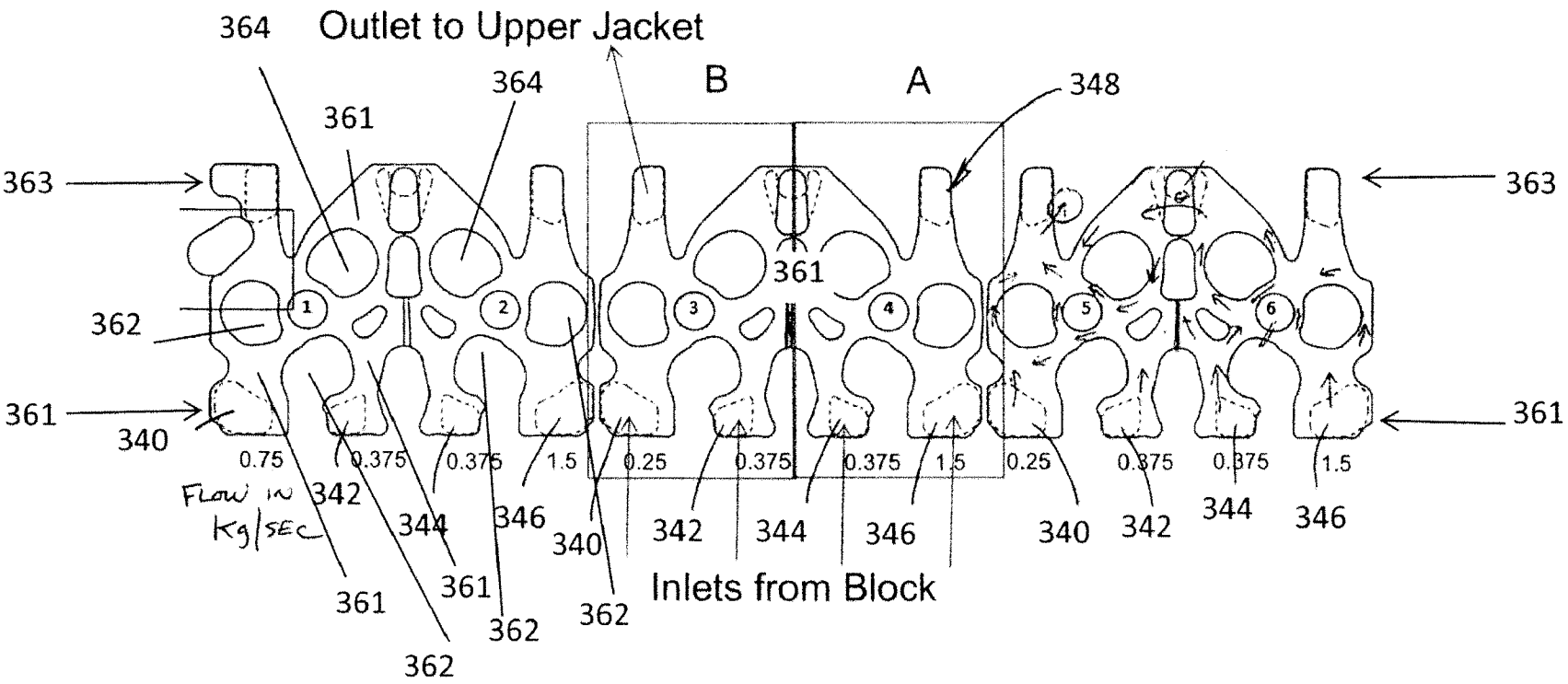
FIG. 7 shows a top view of the lower cylinder head portion of FIG. 5*b*.

FIG. 7 shows a top view of the lower cylinder head portion of FIG. 5*b*. As shown in the illustrated embodiment, the lower cylinder head portion 301 includes the inlet passages 340, 342, 344, and 346. The inlet passages are in fluid communication with coolant flow passages 360 forming a coolant manifold in the cylinder head, which passages extend through a lower cylinder head portion 301. The coolant flow passages 360 in the cylinder head portion 301 extend from the intake side 361, extending around the intake ports 362, to the exhaust side 363, extending around the combustion gas exhaust ports 364. In accordance with exemplary embodiments, the coolant flow passages 360 of adjacent cylinders, such as cylinder 1 and 2, may be in fluid communication on the combustion gas exhaust port side to promote coolant flow from passages about the combustion gas exhaust port on one cylinder to flow to the combustion gas exhaust port on the adjacent cylinder. In various exemplary embodiments, the coolant flow from both cylinders of a pair of cylinders, may be combined and flow upwards between the combustion gas exhaust ports. The coolant is then directed to the outlet of the head through a manifold which collects from each cylinder pair. In various exemplary embodiments, the coolant flow from cylinder A is fed back to cylinder B, and out from cylinder B to the upper cylinder head portion or a component performing a manifold function. An advantage of this layout is that it provides for parallel flow through the block and head system leading to low coolant restriction and thus lower potential pressure drop in the cooling system while providing a consistent pattern of heat transfer for each cylinder. In accordance with various embodiments, coolant flowing to and about an exhaust valve of cylinder A may be directed to flow to and about an exhaust valve of adjacent cylinder B. The system provided by the illustrated embodiments allows for a compact, minimally sized external coolant manifold. Additionally, the mirrored layout of the cylinders allows a shorter, more compact exhaust manifold, reducing cost and improving opportunity to design such an exhaust manifold without expansion joints.

As utilized herein, the terms "approximately," "about," "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described without restricting the scope of these features to the precise numerical ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments, and that such variations are intended to be encompassed by the present disclosure. It is recognized that features of the disclosed embodiments can be incorporated into other disclosed embodiments.

It is important to note that the constructions and arrangements of apparatuses or the components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, describes techniques, or the like, this application controls.

While various inventive embodiments have been described and illustrated herein, those of ordinary skill in the art will readily envision a variety of other mechanisms and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way unless otherwise specifically noted. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

The invention claimed is:

1. An engine assembly, the engine assembly comprising:

a cylinder block including:

one or more pairs of cylinder block openings disposed therein, each cylinder block opening configured to house a piston;

one or more cylinder block inlets, each cylinder block inlet disposed between a respective pair of cylinder block openings;

one or more sets of cylinder block passages, each set of cylinder block passages comprising four passages that are connected to a respective cylinder block inlet disposed between a respective pair of cylinder block openings, the four passages comprising:

a first passage connected between the cylinder block inlet and a first cylinder block outlet for a first cylinder block opening of the pair of block openings, the first passage configured to direct coolant flowing around a first side of the first cylinder block opening;

a second passage connected between the cylinder block inlet and a second cylinder block outlet for the first cylinder block opening, the second passage configured to direct coolant flowing around a second side of the first cylinder block opening, wherein the first side of the first cylinder block opening opposite the second side of the first cylinder block opening;

a third passage connected between the cylinder block inlet and a third cylinder block outlet for a second cylinder block opening of the pair of block openings, the third passage configured to direct coolant flowing around a first side of the second cylinder block opening; and a fourth passage connected between the cylinder block inlet and a fourth cylinder block outlet for the second cylinder blocking opening of the pair of block openings, the fourth passage configured to direct coolant flowing around a second side of the second cylinder block opening, wherein the first side of the second cylinder block opening opposite the second side of the second cylinder block opening;

a cylinder head coupled to the cylinder block such that the cylinder head is in fluid communication with the cylinder block; and a coolant manifold coupled to the cylinder block, the coolant manifold including a plurality of coolant flow passages, each coolant flow passage in fluid communication with a respective cylinder block inlet, wherein fluid from each cylinder block inlet diverges into a respective set of cylinder block passages, the set of cylinder block passages extending about a peripheral portion of each of the respective pair of cylinder block openings, wherein each cylinder block passage is configured to direct coolant flowing around the peripheral portion of the respective cylinder block opening into the cylinder head through a respective cylinder block outlet, and wherein the cylinder head is configured to receive coolant from the cylinder block and direct the coolant flowing to and about an intake port of each cylinder and extending from the intake port to and about an exhaust port of the cylinder.

2. An engine assembly according to claim 1, wherein the cylinder head includes a cylinder head coolant manifold, the cylinder head coolant manifold configured to transfer coolant from the exhaust port of a first cylinder to and about an exhaust port of an adjacent cylinder.

3. An engine assembly according to claim 1, wherein the one or more sets of cylinder block passages include a cross channel between each pairof cylinder block openings, the cross channel providing fluid communication between two adjacent sets of cylinder block passages.

4. An engine assembly according to claim 1, wherein each set of cylinder block passages comprising two pairs of passages, and wherein each pair of passages extends bidirectionally about the peripheral portion of a respective cylinder block opening.

5. An engine assembly according to claim 1, wherein the cylinder head comprises a lower cylinder head portion and an upper cylinder head portion, the lower cylinder head portion receiving coolant from the cylinder block and directing the coolant to the upper cylinder head portion.

6. An engine assembly according to claim 1, wherein each cylinder block inlet is spaced substantially equidistant from each of a respective pair of cylinder block openings in the engine block.

7. An engine assembly according to claim 1, wherein each set of cylinder block passages are casted passages.

8. A method of distributing coolant in an engine assembly, the method comprising:

causing coolant to flow from a coolant manifold to a cylinder block coupled to the coolant manifold, the cylinder block including one or more cylinder block inlets, one or more sets of cylinder block passages, and one or more pairs of cylinder block openings disposed therein, each cylinder block opening configured to house a piston, the coolant manifold including a plurality of coolant flow passages, each coolant flow passage in fluid communication with a respective cylinder block inlet, each cylinder block inlet disposed in the cylinder block between a respective pair of cylinder block openings and connected to a respective set of cylinder block passages, the respective set of cylinder block passages comprising four passages configured to direct coolant around the pair of cylinder block openings by:

providing a first passage connected between the cylinder block inlet and a first cylinder block outlet for a first cylinder block opening of the pair of cylinder block openings, and causing coolant flowing around a first side of the first cylinder block opening through the first passage;

providing a second passage connected between the cylinder block inlet and a second cylinder block outlet for the first cylinder block opening, and causing coolant flowing around a second side of the first cylinder block opening through the second passage, wherein the first side of the first cylinder block opening opposite the second side of the first cylinder block opening;

providing a third passage connected between the cylinder block inlet and a third cylinder block outlet for a second cylinder block opening of the pair of cylinder block openings, and causing coolant flowing around a first side of the second cylinder block opening through the third passage; and providing a fourth passage connected between the cylinder block inlet and a fourth cylinder block outlet for the second cylinder block opening, and causing coolant flowing around a second side of the second cylinder block opening through the fourth passage, wherein the first side of the second cylinder block opening opposite the second side of the second cylinder block opening;

causing coolant to flow from the cylinder block to a cylinder head coupled to the cylinder block, wherein causing the coolant to flow to the cylinder block includes causing the coolant from each cylinder block inlet to diverge into a respective set of cylinder block passages, each cylinder block passage extending about a peripheral portion of a respective cylinder block opening in the respective pair of cylinder block openings, and wherein each cylinder block passage extends from the peripheral portion of the respective cylinder block opening into the cylinder head through one or more cylinder block outlets; and causing coolant to flow into a cylinder head coolant manifold of the cylinder head from the one or more cylinder block outlets from the engine block, the cylinder head coolant manifold including a water jacket adjacent to a valve seat of an air intake port, the water jacket in fluid communication with an area adjacent to a valve seat of a combustion gas exhaust port.

9. A method of distributing coolant in an engine assembly 8, further comprising causing coolant to flow in the water jacket from an area adjacent to the valve seat of the combustion gas exhaust port of one cylinder to an area adjacent to the valve seat of the combustion gas exhaust port of an adjacent cylinder.

10. A method of distributing coolant in an engine assembly 8 further comprising causing fluid to flow between each pair of cylinder block openings via a cross channel between the cross channel providing fluid communication between adjacent sets of cylinder block passages.

11. A cooling system for an engine, comprises:

a cylinder block jacket coupled to a cylinder block, wherein the cylinder block comprising one or more pairs of cylinder block openings, the cylinder block jacket comprising:

one or more cylinder block inlets receiving coolant from a coolant manifold, the one or more cylinder block inlets located at a first side of the cylinder block, each cylinder block inlet located between a pair of cylinder block openings;

one or more sets of cylinder block outlets located at a second side of the cylinder block, the second side of the cylinder block opposite the first side of the cylinder block; and one or more sets of cylinder block passages, each set of cylinder block passages connected between a respective cylinder block inlet located between a pair of cylinder block openings and a respective sets of cylinder block outlets, each set of cylinder block passages comprising four passages including:

a first passage connected between the cylinder block inlet and a first cylinder block outlet of the sets of cylinder block outlets, the first passage configured to direct coolant flow around a first cylinder block opening of the pair of cylinder block openings;

a second passage connected between the cylinder block inlet and a second cylinder block outlet of the set of cylinder block outlets, the second passage configured to direct coolant flow around the first cylinder block opening;

a third passage connected between the cylinder block inlet and a third cylinder block outlet of the set of cylinder block outlets, the third passage configured to direct coolant flow around a second cylinder block opening of the pair of cylinder block openings; and a fourth passage connected between the cylinder block inlet and a fourth cylinder block outlet of the set of cylinder block outlets, the fourth passage configured to direct coolant flow around the second cylinder block opening.

12. A cooling system according to claim 11, wherein the coolant manifold comprises one or more coolant passages, each coolant passage connected to a respective cylinder block inlet.

13. A cooling system according to claim 11, further comprising a lower cylinder head jacket in fluid communication with the cylinder block water jacket.

14. A cooling system according to claim 13, wherein the lower cylinder head jacket comprises one or more sets of lower cylinder head jacket inlets, each lower cylinder head jacket inlets connected to a respective cylinder block outlet.

15. A cooling system according to claim 14, wherein the lower cylinder head jacket comprises one or more sets of lower cylinder head passages, each lower cylinder head passage connected to a lower cylinder head inlet, each set of lower cylinder head passages connected to a single lower cylinder head outlet.

16. A cooling system according to claim 15, wherein each lower cylinder head passage is configured to receive coolant from a respective lower cylinder head inlet.

17. A cooling system according to claim 15, wherein each set of lower cylinder head passages is configured to direct coolant around intake valves, injector, and exhaust valves seat of each of a respective pairs of cylinders.

18. A cooling system according to claim 13, further comprising an upper cylinder head jacket in fluid communication with the lower cylinder head jacket.

19. A cooling system according to claim 18, wherein the upper cylinder head jacket comprises one or more upper cylinder head inlets, each upper cylinder head inlet connected to a respective lower cylinder head outlet.

20. L cooling system according to claim 19, wherein the upper cylinder head jacket comprises one or more upper cylinder head passages, each upper cylinder head passage connected to a respective upper cylinder head inlet.

* * * * *